United States Patent [19]

McLane

[11] 4,083,478

[45] Apr. 11, 1978

[54] MOLTEN METAL SHUT-OFF VALVE UTILIZING COOLING TO SOLIDIFY METAL FLOW

[75] Inventor: Jack E. McLane, Port Huron, Mich.

[73] Assignee: Wirtz Manufacturing Company, Inc., Port Huron, Mich.

[21] Appl. No.: 743,854

[22] Filed: Nov. 22, 1976

[51] Int. Cl.[2] ..... B22D 41/08

[52] U.S. Cl. ..... 222/592; 164/337; 222/594; 222/146 C

[58] Field of Search ..... 164/337; 266/266, 271, 266/272; 222/146 C, 590, 591, 592, 593, 594, 597

[56] References Cited

U.S. PATENT DOCUMENTS

| | | | |
|---|---|---|---|
| 673,556 | 5/1901 | Hartman | 266/272 X |
| 3,052,253 | 9/1962 | Priaroggia et al. | 137/251 X |
| 3,828,974 | 8/1974 | Tenner | 266/272 X |
| 3,877,620 | 4/1975 | Rader | 222/537 |

*Primary Examiner*—Robert B. Reeves
*Assistant Examiner*—David A. Scherbel
*Attorney, Agent, or Firm*—Barnes, Kisselle, Raisch & Choate

[57] ABSTRACT

In a battery grid casting machine there is provided in the feed line from the lead pot to the lead dispensing valve a shut-off valve having a passageway therethrough of relatively small cross section which is surrounded by a water jacket such that, when cold water is directed through the water jacket, the lead in the restricted passageway solidifies into a solid slug and prevents the further flow of lead therethrough.

8 Claims, 3 Drawing Figures

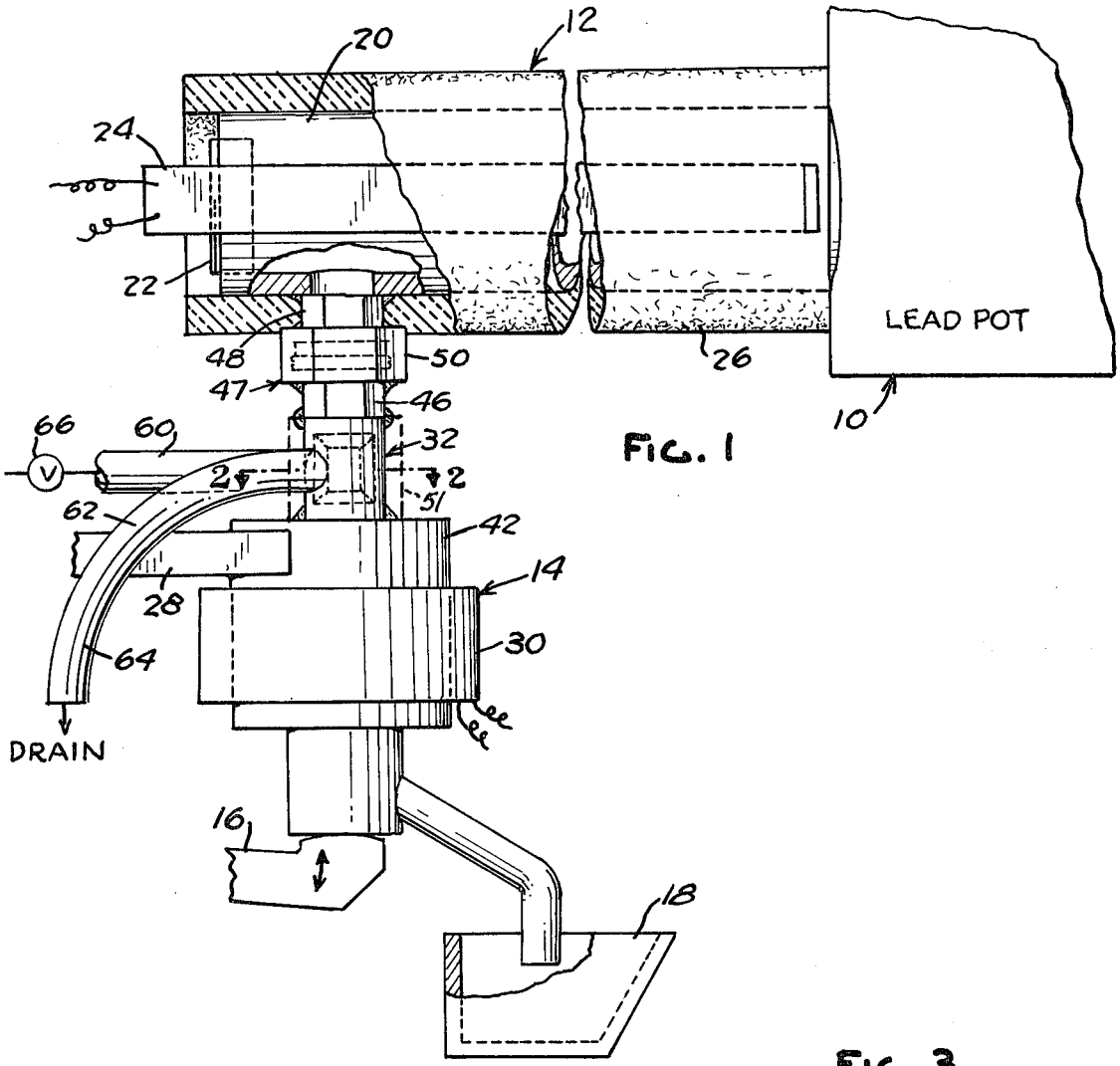
FIG. 1
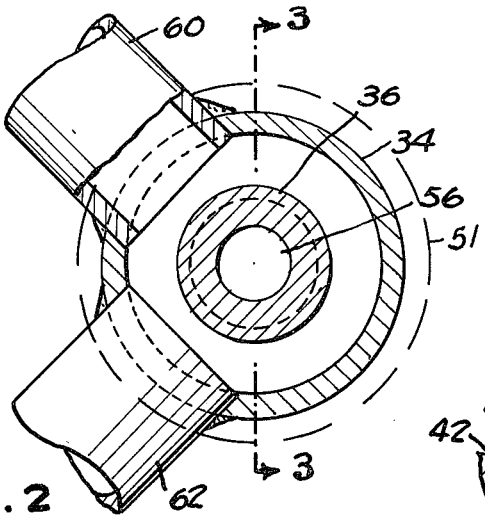
FIG. 2
FIG. 3
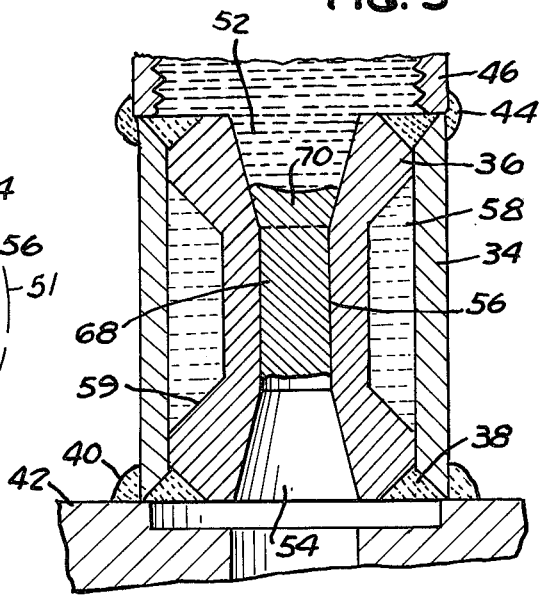

MOLTEN METAL SHUT-OFF VALVE UTILIZING COOLING TO SOLIDIFY METAL FLOW

This invention relates to a battery grid casting machine, and, more particularly, to a shut-off valve for such machine for stopping the flow of molten lead from the lead pot to a lead dispensing valve assembly. Battery grid casting machines normally include a feed line extending from a lead pot to a valve for dispensing a predetermined quantity of molten lead at regular intervals to a ladle which in turn discharges the lead into a battery grid mold. One such arrangement is disclosed in U.S. Pat. No. 3,877,620, dated Apr. 15, 1975. During normal operation of such grid casting machines it sometimes becomes necessary to stop the flow of molten lead from the lead pot to the dispensing valve in order to service the valve or for some other reason. Thus, a shut-off valve is frequently employed in the molten lead feed line upstream of the dispensing valve.

The primary object of this invention is to provide a shut-off valve for quickly stopping the flow of molten lead in the feed line of the machine and for thereafter initiating the flow without undue delay.

A further object of the invention is to provide a valve of the above type which incorporates no moving parts, which is dependable in its operation and which is not subject to malfunction due to a failure of packing or sealing parts.

More specifically, the valve of the present invention comprises a flow member in the feed line from the lead pot to the dispensing valve having a passageway therein of reduced cross section which allows enough lead to flow through smoothly without turbulence during normal operation to suit the desired casting operation. The restricted passageway of the valve is surrounded by a coolant chamber which, when supplied with coolant, cold water for example, chills the passageway very rapidly to solidify the lead flowing therethrough into a solid slug which then blocks the passageway against further flow. The restricted passageway is designed such that the shape of the solid slug and the weight of the liquid lead column above it provides a very effective seal and a complete shut off of flow therethrough. In addition, the shut-off valve is so located in relation to the feed line and to the dispensing valve that upon draining of the coolant chamber the solidified slug in the restricted passageway is quickly heated to the melting temperature of the lead to re-establish the flow through the valve in a minimum of time.

Other objects, features and advantages of the present invention will become apparent from the following description and accompanying drawing, in which:

FIG. 1 is a fragmentary view, with parts broken away, showing a portion of a battery grid casting machine incorporating the shut-off valve of this invention;

FIG. 2 is a sectional view of the valve of this invention taken along the line 2—2 in FIG. 1; and FIG. 3 is a sectional view taken along the line 3—3 in FIG. 2.

In the drawing the lead pot for the battery grid casting machine is designated 10. A feed line 12 for molten lead is connected to the lower end of lead pot 10 and directs lead to a dispensing valve 14. As is disclosed in U.S. Pat. No. 3,877,620, valve 14 is operated intermittently by a suitable mechanism including a lever 16 in timed relation to the opening and closing of the battery grid mold to discharge a predetermined quantity of lead to a tipping ladle 18 for filling the mold when the latter closes. Feed line 12 comprises a pipe 20 extending horizontally from lead pot 10 and having a removable plug 22 at the end thereof for clean out purposes. Pipe 20 is maintained at an elevated temperature by any suitable means, such as one or more electrical heater strips 24 secured to the outer surface of the pipe. The pipe is preferably covered with a layer of insulation 26. The insulated and heated pipe assures maintaining the molten lead therein at the desired temperature.

Dispensing valve 14 is of any suitable construction for discharging a predetermined quantity of lead to ladle 18 in timed relation with the opening and closing of the mold. Valve 14 is supported on the machine by means of a bracket 28 and is preferably heated, as by an electrical heater 30, to maintain the lead following therethrough at an elevated temperature.

The shut-off valve of the present invention is generally designated 32 and is disposed vertically between valve 14 and feed line 12. Valve 32 comprises an outer sleeve 34 and an inner sleeve 36 which are welded together as at 38. Outer sleeve 34 is in turn welded as at 40 to the upper section 42 of valve 14. The upper end of sleeve 34 is welded as at 44 to the lower coupling 46 of a pipe union 47. The upper coupling 48 of the union is welded to pipe 20 and the two couplings 46,48 are connected together by a conventional union coupling nut 50. As shown in FIG. 1, the upper coupling 48 is connected to pipe 20 at a point spaced from the plugged end of the pipe so that valve 32 is at all times subjected to the heat of molten lead directly above it. Valve 32 is preferably enclosed in insulation as indicated at 51.

As shown in FIGS. 2 and 3, outer sleeve 34 is in the form of a short section of tubing, preferably stainless steel, while the inner sleeve 36, also formed of stainless steel, is machined to the configuration shown. Sleeve 36 has a vertically extending passageway therethrough which comprises an inlet passageway 52, an outlet passageway 54, and an intermediate passageway 56. Inlet and outlet passageways 52,54 are conically shaped and intermediate passageway 56 is of cylindrical shape. It will be observed that the side walls of the inlet and outlet passageways taper gradually to the diameter of the intermediate passageway 56. The wider mouths of the inlet and outlet passageways have a diameter smaller than the inner diameter of the pipe union connecting valve 32 with feed line 12. It will also be noted that the intermediate passageway 56 has a diameter less than its length. Preferably the length of the intermediate passageway 56 is at least twice its diameter. In any event, the length of passageway 56 should be at least as large as its diameter. Inner sleeve 36 has its external surface undercut at the vertically central section thereof such as to provide a relatively large annular coolant chamber 58 between sleeves 34,36. Coolant chamber 58 has a length at least slightly greater than passageway section 56 so that is surrounds at least the lower end of inlet passageway 52. The bottom wall 59 slopes downwardly in a radially outward direction.

A coolant inlet conduit 60 is welded to sleeve 34 at one side thereof. A coolant outlet conduit 62 is welded to sleeve 34 at a point spaced circumferentially from conduit 60. The outlet conduit 62 extends downwardly as at 64 from its connection with sleeve 34 and is connected to sleeve 34 adjacent the lower end of chamber 58 so that, when the flow of coolant into chamber 58 is stopped by actuating a valve 66, located in conduit 60 closely adjacent valve 32, chamber 58 will be immediately completely drained of coolant. Most any type of coolant capable of extracting heat rapidly from valve 32 may be employed. However, in practice it is found that cold water works very satisfactorily.

In normal operation of the grid casting machine the coolant valve 66 is closed so that coolant chamber 58 is merely filled with air. Molten lead from pot 10 flows through pipe 20 and is maintained at a suitable temperature by strip heater 24. The molten lead flows downwardly from feed line 12 through sleeve 36 and into dispensing valve 14. As pointed out previously, valve 14 is intermittently opened and closed as by lever 16 to discharge predetermined amounts of lead into ladle 18, which is periodically tipped to fill the mold each time it closes. In the event it becomes necessary to stop the flow of lead to valve 14, valve 66 is opened to direct a large flow of water through conduit 60, around chamber 58 and to drain through conduit 62. The passageway through inner sleeve 36, particularly intermediate passageway 56, is dimensioned such that the lead flowing therethrough solidifies very rapidly into a solid slug 68 very quickly. For example, if passageway 56 has a diameter of about ¼ inch and a length of about ½ inch the lead flowing therethrough will solidify into a solid slug within about two seconds after cold water is directed through chamber 56.

Experience has shown that, when cold water directly from a conventional main without being otherwise refrigerated is used as the coolant the intermediate passageway 56 should not have a diameter in excess of about ¼ inch in order to obtain solidification of the lead within a reasonably short time. Although the diameter of passageway 56 is ¼ inch or less, the conical shape of the inlet passageway 52 produces a smooth flow of lead through the valve without turbulence and at a rate sufficient to fill a battery grid mold in a reasonably short time. The conical shape of the side wall of inlet passageway 52 has another desirable function. When cold water is directed through chamber 58 the lead therein solidifies in passageway 56 to form the solid slug 68 therein. However, the cooling effect of the cold water circulating through chamber 58 also causes at least a small portion of the lead in inlet passageway 52 to solidify as at 70. The solidified section 70 is in the form of a tapered head on slug 68. The weight of the liquid column above the solidified head 70 forces it downwardly into tight sealing engagement with the conical wall of inlet 52. Thus, the tapered wall of inlet passageway 52 serves as a valve seat for head 70. This prevents leakage of lead through the shut-off valve and assures a complete shut-off of the flow, even though slug 70 shrinks as it solidifies. As long as cold water is circulated through chamber 58 the solidified slug of lead will prevent the further flow to dispensing valve 14. This is true even though external heat is supplied to the feed line and valve 14. As a matter of fact, it is desirable to continue the supply of heat above and below valve 32 so that as soon as the flow of cold water through chamber 58 is stopped the solidified slug will be subjected to surrounding heat and start to remelt.

After valve 14 has been serviced and it is desired to re-initiate the flow of lead therethrough, valve 66 is actuated to stop the flow of coolant through chamber 58. Thus, the water drains immediately from chamber 58 and the heat of the molten lead and adjacent metal members above the valve as well as below it quickly elevates the temperature of solid slug 68 so that it melts to again establish flow through valve 32. The provision of insulation around valve 32 reduces to a minimum the time required to melt slug 68. With the arrangement described the solid slug can be completely liquified within two minutes after chamber 58 is drained.

Thus, it will be seen that I have provided a shut-off valve in the feed line which has no moving parts and which, therefore, operates dependably over a long period of time. The metal from which the valve components are made has enough strength to withstand the shock of quickly changing temperatures. It will also be noted that the valve components are welded together and that the valve itself is welded to the adjacent assemblies of the lead feeding and dispensing system. Threaded connections are thus eliminated and malfunctioning due to the failure of seals, etc. is also completely eliminated.

I claim:

1. In a battery grid casting machine having a feed line extending downwardly from a lead pot to a lead dispensing valve, the improvement which comprises, a shut-off valve arranged vertically in said downwardly extending feed line, said shut-off valve having inner and outer sleeves cooperating to define an annular coolant chamber therebetween, means for directing coolant through said chamber and for shutting off the flow of coolant thereto, said inner sleeve having a vertically downwardly extending inlet passageway at its upper end connected to said feed line and an outlet passageway at its lower end connected to said dispensing valve, said inner sleeve also having an intermediate passageway extending vertically between said inlet and outlet passageways, said intermediate passageway being of substantially reduced cross section relative to said inlet passageway and said feed line, said inlet passageway decreasing progressively in cross section to said intermediate passageway, said coolant chamber surrounding said intermediate passageway so that when coolant is directed through said coolant chamber the lead in said intermediate passageway solidifies into a plug which interrupts the flow to the dispensing valve, and means for heating the dispensing valve to maintain the lead therein in a molten condition, said shut-off valve being disposed adjacent and directly above said dispensing valve in heat exchange relation thereto so that when the flow of coolant through said coolant chamber is discontinued the heat transferred from the dispensing valve to the shut-off valve assists in melting the plug of lead solidified therein.

2. The improvement called for in claim 1 wherein said intermediate passageway is of cylindrical shape and said inlet passageway is of conical shape.

3. The improvement called for in claim 2 wherein said coolant chamber surrounds at least the lower end portion of said inlet passageway.

4. The improvement called for in claim 3 wherein the length of the intermediate passageway is equal to at least the diameter thereof.

5. The improvement called for in claim 4 wherein the length of the intermediate passageway is about twice the diameter thereof.

6. The improvement called for in claim 1 including means for heating the portion of the feed line directly adjacent its connection with the shut-off valve.

7. The improvment called for in claim 6 including insulation surrounding said shut-off valve.

8. The improvement called for in claim 1 wherein said coolant directing means comprises an inlet conduit connected with said chamber and an outlet conduit connected with said chamber adjacent the lower end thereof, said outlet conduit extending downwardly from said chamber to drain so that when the flow of coolant to said chamber is stopped the chamber is completely drained of coolant.

* * * * *